United States Patent [19]

Arai et al.

[11] 3,979,306

[45] Sept. 7, 1976

[54] METHOD AND COMPOSITION FOR FINISHING CLOTHINGS TO PREVENT YELLOWING

[75] Inventors: Haruhiko Arai, Narashino; Junryo Mino, Kamagaya, both of Japan

[73] Assignee: Kao Soap Co., Ltd., Tokyo, Japan

[22] Filed: Nov. 15, 1973

[21] Appl. No.: 416,194

[30] Foreign Application Priority Data

Nov. 21, 1972 Japan ..... 47-116783

[52] U.S. Cl. ..... 252/8.6; 106/170; 106/213; 106/287 R; 106/287 SC; 252/8.8; 252/8.9

[51] Int. Cl.[2] ..... D06M 13/16; D06M 13/46

[58] Field of Search..... 252/547, 8.6, 8.9, 45.75 W, 252/8.8; 117/113; 106/287 SC, 287 R, 170, 189, 213, 45.95 C, 45.95 R

[56] References Cited

UNITED STATES PATENTS

| | | | |
|---|---|---|---|
| 2,567,722 | 9/1951 | Marberg et al. | 106/170 |
| 3,036,935 | 5/1962 | Lolkema | 117/139.5 |
| 3,835,095 | 9/1954 | Mijs et al. | 106/189 |

OTHER PUBLICATIONS

Burrys et al. Def. Pub. of Ser. No. 763,395, filed 9/68, Published in 875 O.G. 11, 6/70, Def. Publ. No. T 875,001.

*Primary Examiner*—Theodore E. Pertilla
*Attorney, Agent, or Firm*—Woodhams, Blanchard and Flynn

[57] ABSTRACT

Clothings are treated with a finishing agent composition containing one or more of the following compounds blended therein:

4,4′-butylidene-bis(6-tert.-butyl-3-methylphenol),
2,2′-butylidene-bis(6-tert.-butyl-4-methylphenol),
4,4′-thio-bis(6-tert.-butyl-3-methylphenol),
4,4′-thio-bis(6-tert.-butyl-2-methylphenol),
styrenated phenol, trisalkylphenylphosphite (in which the alkyl group has 8 to 14 carbon atoms) and dialkyl 3,3′-thiodipropionate (in which the alkyl group has 14 to 18 carbon atoms), to reduce yellowing of clothings.

3 Claims, No Drawings

METHOD AND COMPOSITION FOR FINISHING CLOTHINGS TO PREVENT YELLOWING

BACKGROUND OF THE INVENTION

1. Field of the Invention

This invention relates to a finishing agent composition for minimizing yellowing of clothes. Further, this invention provides a method for finishing clothing by treating the same with such finishing agent composition to prevent yellowing of clothing.

2. Description of the Prior Art

In general, worn clothing is soiled with oily grime deposited thereon, which is principally due to secretions from the human body and such oily grime cannot fully be removed by ordinary home washing. The thus remaining oily grime is auto-oxidized during wearing or storage of the clothing, whereby it will cause yellowing of clothing or it will be made insoluble due to polymerization.

It is a primary object of this invention to prevent oily grime deposited on clothing, which remains thereon even after washing with a detergent, from yellowing, polymerizing or being denatured.

SUMMARY OF THE INVENTION

The above object of this invention can be achieved by effecting, after washing the clothing, a treatment with a finishing agent composition in which one or more of the following compounds are incorporated:

4,4'-butylidenebis(6-tert.-butyl-3-methylphenol),
2,2'-butylidenebis(6-tert.-butyl-4-methylphenol),
4,4'-thiobis(6-tert.-butyl-3-methylphenol),
4,4'-thiobis(6-tert.-butyl-2-methylphenol),
styrenated phenol,
trisalkylphenylphosphite (in which the alkyl group has 8 to 14 carbon atoms) and dialkyl 3,3'-thiodipropionate (in which the alkyl group has 14 to 18 carbon atoms).

All of the above-mentioned compounds are included within the category of anti-oxidants and each of the above compounds possesses the following essential features:

1. It forms a stable finishing agent composition.
2. It adheres to clothing or remaining oily grime ingredient.
3. It is stable against change of conditions and it does not cause any yellowing by itself.

The finishing agent composition of this invention comprises as an essential component the above mentioned anti-oxidant. The scope of the present finishing agent composition is not particularly limited but it is preferably formed into a softening agent composition or starching agent composition in which the above specific anti-oxidant compound is incorporated in an amount of about 0.001 – 5% by weight, preferably 0.01 – 0.5% by weight.

Accordingly, a preferred example of the finishing agent composition of the present invention is the following starching (or sizing) agent composition incorporated with the above anti-yellowing agent:

| | |
|---|---|
| Carboxymethyl cellulose, starch, polyvinyl alcohol, polyvinyl acetate or mixtures thereof (Starching agent) | 10 – 99% by wt. |
| Anti-yellowing agent | 0.001 – 5% by wt. |
| Water | balance |

Further, another preferred example of the finishing agent composition of the present invention is the following softening agent composition incorporated with the above anti-yellowing agent:

| | |
|---|---|
| Cationic surface active agent such as di-long chain alkyl ($C_{12}$–$C_{18}$) dimethyl ammonium chloride (Softening agent) | 0.1 – 10% by wt. |
| Stabilizing agent (polyoxyethylene dodecyl ether, ethylene glycol, isopropyl alcohol, etc.) | 0.1 – 20% by wt. |
| Anti-yellowing agent | 0.001 – 5% by wt. |
| Water | balance |

In treating clothing after washing by a finishing agent composition of the present invention such as mentioned above, the finishing agent composition should be diluted with water so as to make the concentration of the anti-yellowing agent in the aqueous solution to be 1 to 50 ppm. The clothing are to be immersed in the treating solution thus prepared for more than 2 minutes and then dried.

In treating clothing by the above finishing agent composition of the present invention, the anti-yellowing agent contained in the composition does not harm the inherent properties of the starching agent, softening agent, etc. at all.

This invention will now be further explained by means of the following illustrative Examples.

EXAMPLE 1

A softening agent composition (A) having the following formulation was prepared:

| | % by weight |
|---|---|
| Distearyldimethylammonium chloride | 8.0 |
| Polyoxyethylene ($\overline{P}$ = 45) lauryl ether | 1.5 |
| Propylene glycol | 3.6 |
| Sodium chloride | 0.04 |
| 4,4'-thiobis(6-tert.-butyl-3-methylphenol) | 0.16 |
| Water | balance |

The above softening agent composition is a stable liquid composition possessing a good softening effect.

Then, with respect to the above composition (A) and a composition (B) in which the anti-yellowing agent is omitted from the composition (A), comparative test was made.

Cotton underwears were applied to five adult men. After being worn for one day, the underwears were washed and subjected to softening treatment. This course of action was repeated ten times. After completion of the treatment, the cotton underwears were allowed to stand for 30 days at 40°C under 80% RH condition. Thereafter, visual investigation was effected by ten judges by comparing a pair of the above underwears. A sample which looked more white was given +1 point, whereas a sample which looked less white was given 0 (zero) point. The results obtained are shown in the Table 1 below.

Table 1

| Softening Agent composition | Judgement for Whiteness |
|---|---|
| A | 49 points |
| B | 1 |

EXAMPLE 2

In the softening agent composition (A) shown in Example 1, only the anti-yellowing agent was replaced 4,4'-butylidenebis(6-tert.-butyl-3-methylphenol) or trisnonylphenylphosphite. These softening agent compositions exhibited also a good anti-yellowing effect.

EXAMPLE 3

A composition (D) prepared by incorporating 0.05% by weight of an anti-yellowing agent (styrenated phenol) to a starching agent composition (C) which comprises

| | |
|---|---|
| polyvinyl acetate emulsion (50% concentration) | 95% by weight |
| polyoxyethylene ($\overline{P}$ = 30) lauryl ether | 5% by weight |

is a stable liquid composition which will impart good ironing property and feeling to the treated fabric.

With respect to the above compositions, the anti-yellowing effect was compared by a practical test using cotton pillow covers.

Cotton pillow covers were applied to five adult men. They were used for 4 days and then washed and starching was effected. This course of action was repeated 10 times and thereafter the similar judgement as in Example 1 was made. The results obtained are as shown in the Table 2 below.

Table 2

| Starching Agent Composition | Judgement for Whiteness |
|---|---|
| C | 4 points |
| D | 46 |

The embodiments of the invention in which an exclusive property or privilege is claimed are defined as follows:

1. A clothes starching composition consisting essentially of from 10 to 99 percent of a starching agent selected from the group consisting of carboxymethyl cellulose, starch, polyvinyl alcohol, polyvinyl acetate and mixtures thereof, from 0.001 to 5 percent by weight of an anti-yellowing agent selected from the group consisting of 4,4'-butylidene-bis(6-tert.-butyl-3-methyl-phenol), 2,2-butylidene-bis(6-tert.-butyl-4-methylphenol), 4,4'-thio-bis(6-tert.-butyl-3-methyl-phenol) and 4,4'-thio-bis(6-tert.-butyl-2-methyl-phenol, and the balance is water.

2. A clothes starching composition as claimed in claim 1, wherein the amount of said anti-yellowing agent is from 0.01 to 0.5 percent by weight.

3. A method which comprises immersing clothing for more than 2 minutes in an aqueous bath obtained by diluting the composition of claim 2 with water so that the concentration of said substance in said bath is from one to 50 ppm and then drying the clothing.

* * * * *